United States Patent [19]

Knobloch

[11] Patent Number: 4,502,859

[45] Date of Patent: Mar. 5, 1985

[54] HIDE TANNING COMPOSITION AND METHOD OF PREPARING SAME

[75] Inventor: Dale B. Knobloch, Northglenn, Colo.

[73] Assignee: Rockmont Industries, Inc., Broomfield, Colo.

[21] Appl. No.: 483,531

[22] Filed: Apr. 11, 1983

[51] Int. Cl.[3] ..... C14C 3/02; C14C 3/04; C14C 3/06

[52] U.S. Cl. ..... 8/94.29; 8/94.19 R; 8/94.27; 8/94.28

[58] Field of Search ..... 8/94.29, 94.19 R, 94.27, 8/94.28

[56] References Cited

U.S. PATENT DOCUMENTS

| | | | |
|---|---|---|---|
| 167,866 | 6/1875 | Angus | 8/94.15 |
| 1,210,968 | 1/1917 | Nasse | 8/94.29 |
| 1,346,385 | 7/1920 | Rogers | 8/94.29 |
| 2,029,088 | 1/1936 | Turley et al. | 8/94.29 |
| 2,942,930 | 6/1960 | Luvisi et al. | 8/94.29 |
| 3,180,827 | 4/1965 | Martinek et al. | 252/25 |
| 3,555,159 | 1/1971 | Feldman | 424/302 |
| 3,690,812 | 9/1972 | Klein | 8/94.27 |
| 3,826,610 | 7/1974 | Komarek et al. | 8/94.26 |
| 3,971,626 | 7/1976 | Heyden et al. | 8/94.23 |
| 4,134,867 | 1/1979 | Töpfl | 260/21 |
| 4,264,319 | 4/1981 | Plapper et al. | 8/94.26 |
| 4,270,912 | 6/1981 | Prentiss | 8/94.26 |
| 4,272,242 | 6/1981 | Plapper et al. | 8/94.15 |

FOREIGN PATENT DOCUMENTS

| | | |
|---|---|---|
| 539417 | 4/1957 | Canada . |
| 1093889 | 12/1967 | United Kingdom . |

*Primary Examiner*—Maria Parrish Tungol
*Attorney, Agent, or Firm*—John E. Reilly

[57] ABSTRACT

An animal hide tanning composition is comprised by weight of minor proportions of borax and alum blended together with an emulsifying agent in a carrier containing water and water-emulsive oils. In the method of preparing the composition, the sequence of blending is extremely important to achieve desired consistency and assure complete dissolution of the active ingredients while retaining the preservative qualities thereof. If a bactericide and parasiticide are to be included, they may be added during the initial blending step. The emulsifying agent acts as a stabilizer to maintain the composition in a readily usable physical state while the addition of a bactericide and parasiticide prevent decay of the tanned hide otherwise resulting from organisms which may be present in the hide.

16 Claims, No Drawings

HIDE TANNING COMPOSITION AND METHOD OF PREPARING SAME

This invention relates to a novel and improved tanning composition for use in the preservation and mounting of animal skins and to a method of preparing such composition for use in a one-step tanning operation.

BACKGROUND AND FIELD OF THE INVENTION

The preservation of animal hides in the naturally appearing state is well-recognized. Such preservation of skins yields wearing apparel as well as decorative rugs, wall hangings and, of course, mounted animals prepared through the art of taxidermy.

Important to producing an acceptable work product is the treatment of the skin or hide of the subject animal. This treatment not only must not destroy the beauty of the skin, but also must preserve its integrity for ultimate use. Present treatment procedures generally employ a multi-step program wherein various ingredients are individually introduced to the subject hide at spaced time intervals under specific ambient conditions. Although present treatment procedures may incidentally include utilization of certain of the ingredients employed in the novel composition and process of the present invention, no one to my knowledge has devised a satisfactory method and means for combining the ingredients into one solution which may be applied in a single application to the skin or hide. Representative patents which typify conventional tanning compositions and methods of preparing same are U.S. Pat. No. 3,180,827 to T. W. Martinek et al; U.S. Pat. No. 3,555,159 to L. I. Feldman; U.S. Pat. No. 3,690,812 to A. Klein; U.S. Pat. No. 3,826,610 to E. Komarek et al.; U.S. Pat. No. 3,971,626 to R. Heyden et al.; U.S. Pat. No. 4,134,867 to R. Topfl; U.S. Pat. No. 4,264,319 to J. Plapper et al.; U.S. Pat. No. 4,270,912 to W. O. Prentiss; and U.S. Pat. No. 4,272,242 to J. Plapper et al. as well as British Pat. No. 1,093,889 and Canadian Pat. No. 539,417.

SUMMARY OF THE INVENTION

It is an object of this invention to provide for a novel and improved hide tanning solution which is capable of preserving animal skins through a single application.

It is another object of the present invention to provide for a novel and improved hide tanning method and composition composition preferably of cream-like consistency which eliminates a series of laborious time-consuming steps previously required in the tanning of hides and avoids the use of harmful chemicals both in the preparation and use of the method and composition.

It is a further object of the present invention to provide for a method of preparing a hide tanning composition in such a way as to bring about complete dissolution of a number of different ingredients into a solution of the desired consistency while retaining the individual properties of the ingredients in the solution as well as establishing a desired pH level of the solution.

In accordance with the present invention, an animal hide tanning composition comprises by weight minor proportions of borax and alum blended together with an emulsifying agent in a suitable carrier containing major proportions of water and a water-emulsive oil. In the method of preparing the composition, it has been found that the sequence of blending is extremely important to achieve not only the desired consistency in the composition but to assure complete dissolution of the active ingredients while retaining the preservative qualities of those ingredients. Thus, the borax and a portion of the alum are introduced together with the water-emulsive oil into a vat containing the desired quantity of water at an elevated temperature on the order of 120° F. to 135° F. These ingredients are fully intermixed and blended together as a preliminary to adding a portion of the desired total quantity of an emulsifying agent together with additional alum. The emulsifying agent and additional alum are then thoroughly blended into the mixture after which the balance of the emulsifying agent is introduced. Stirring is then continued until blending is completed. Here, the desired consistency is regulated by the relative amounts of water-emulsive oil and water present in the composition. Bactericides and parasiticides, such as, phenol are added during the initial blending step.

In a preferred composition, on the order of 5.5 to 7 parts borax are employed together with 5.5 to 7.5 parts alum by weight and a bactericide and parasiticide. The carrier is preferably comprised on the order of 100 parts water and 90 to 105 parts water-emulsive oil. The total parts by weight of emulsifying agent are on the order of 10 to 14 parts with 3 to 5 parts by weight of the emulsifying agent initially introduced in the second step and the balance introduced together with a portion of the alum in the third step of the blending process. Preferably, the pH level of the composition is less than 5.5 and is in the range of 4.5 to 5.5 so as to be most beneficial for effective tanning. The emulsifying agent acts as a stabilizer to maintain the composition in a readily usable physical state while the addition of a bactericide and parasiticide prevent decay of the tanned hide otherwise resulting from organisms which may be present in the hide.

The above and other objects, advantages and features of the present invention will become more readily understood from a consideration of the following detailed description of preferred and alternative compositions and methods of preparing same.

DETAILED DESCRIPTION OF THE PREFERRED EMBODIMENT

In accordance with the present invention, an animal hide tanning composition is prepared in such a way as to permit its one-step application to an animal skin or hide which has previously been prepared for tanning. Active ingredients in preparing the composition are 10 mole borax (sodium borate decahydrate) and an alum (ammonium aluminum sulphate dodecohydrate), the borax and alum being present in substantially equal amounts by weight. Preferably, in the final composition, the borax and alum are present in the amounts of 5.5 to 7 parts by weight. If a salt, e.g., sodium chloride is added, it is present in the amount of 1 to 3 parts by weight. The alum compounds when present in the quantities indicated above are hydrated, such as, ammonium aluminum sulphate dodecohydrate; or may be selected from commercially available alum compounds including potassium chrome alum, sodium aluminum alum, potassium aluminum alum and ammonium iron alum. The active ingredients described above are combined in a carrier preferably made up of water and water-emulsive oil. The water-emulsive oil is preferably selected from water emulsive oils specially formulated for tanning purposes. For instance, Mobil Met is an water-emulsive oil manufactured and sold by Mobil Oil Corporation of New York City, N.Y. A preferred formulation is Mobil Met S122 (diluted) which is customarily employed as a metal cutting fluid. "Dymasol" is a vegetable oil customarily used as a tanning agent and is manufactured and sold by Diamond Shamrock Corporation of Morristown, N.J.

In the composition, the borax is operative to raise the pH level to an amount capable of avoiding excessive acidity as well as to act as a preservative. The alum reacts to form an acid which is effective to pickle the skin. The same is true of a blending agent sold under the trademark "YLA" by The Richardson Company of Patterson, N.J., and present in minor proportions on the order of two quarts to one gallon.

A preferred emulsifying agent is a silica sand in fine powder form sold under the trademark "Aerosil" by Degussa Corporation of Teterboro, N.J. Another fuming silica compound which may be used is Cabosil sold by the Cabot Company of Tuscola, Ill. The emulsifying agent is combined with the other ingredients which not only acts as a stabilizer for the chemicals and eliminates shrinkage of the hide, but further will thicken and convert the solution into a cream of the desired consistency and viscosity.

Additional agents may be intermixed into the composition, such as, suitable bactericides and parasiticides to prevent decay of the tanning hide which could otherwise result from organisms and bacteria present in the hide. In this relation, phenol has been found to be an effective bactericide and avoids the use of strong acids, such as, hydrogen sulphide. A moth-proofing agent sold under the trademark "Edulan U" by Mobay Chemical Company of Union, N.J. may be introduced in the amount of 3 oz. or less than 1 part by weight.

The following working examples illustrate the makeup of the preferred compositions and the steps followed in preparation of the tanning solution:

| Ingredient | Weight or Volume | Parts By Weight |
|---|---|---|
| borax | 30 Lbs. | 6.25 |
| alum | 36 Lbs. | 7.5 |
| "YLA" | 4.3 Lbs. | 1 |
| water | 60 Gals. | 100.0 |
| "Dymasol" | 30 Gals. | 47.7 |
| "Mobil Met" | 30 Gals. | 46.9 |
| Edulan U | 3 Oz. | <1 |
| phenol | 6 Oz. | <1 |
| "Aerosil" | 50 Lbs. | 11.4 |

A preferred tanning solution was prepared by heating the total quantity of water in a vessel to a temperature on the order of 135° F. The total amount of borax, phenol, Edulan U, YLA, one-third of the alum, and the entire quantity of water-emulsive oils specified above were blended together for approximately one hour. Stirring was then discontinued as a limited quantity of the emulsifying agent, "Aerosil", on the order of one-third of the total amount was added to the mixture together with the balance of the alum. The stirring was then continued to blend in the Aerosil and remainder of the alum. Thereafter, the balance of the Aerosil was added and stirred into the mixture. Aerosil is generally supplied in fine powder form and it is therefore advisable to discontinue the stirring when the Aerosil is introduced into the mixture. Important to the relative amounts of borax, alum and sodium chloride added is that of maintaining a pH in the range of 4.5 to 5.5; otherwise, if the solution or cream becomes too acidic the skin will tend to swell or deteriorate. This is determined primarily by the amount of alum which is added in the final step. The resultant composition is in the form of a cream, and provides superior tanning results when applied by hand and worked into an animal's skin. As earlier related, only one application of cream to the skin is necessary.

EXAMPLE II

In the same manner as in Example I, but employing variations as shown below in quantities of certain ingredients in steps one, two and three, the following composition was prepared:

| Ingredient | Weight or Volume | Parts By Weight |
|---|---|---|
| borax | 27 Lbs. | 5.6 |
| sodium chloride | 5 Lbs. | 1 |
| alum | 35 Lbs. | 6.6 |
| water | 60 Gals. | 100.0 |
| "YLA" | 8.6 Lbs. | 1.8 |
| "Dymasol" | 30 Gals. | 47.7 |
| "Mobil Met" | 30 Gals. | 46.9 |
| Phenol | 6 Oz. | <1 |
| "Aerosil" | 50 Lbs. | 10.4 |

The solution was prepared by heating the total quantity of water to approximately 120° F. and adding the borax, sodium chloride, phenol and one-third of the alum as well as the entire quantities of water-emulsive oils and stirring until blended. Two-thirds of the Aerosil and the remainder of the alum were then added to the resultant mixture and stirred until blended; thereafter, stirring is discontinued until the balance of the Aerosil is introduced, once again followed by stirring to completely blend.

Once again, the resultant composition was of a cream-like consistency and was found to provide superior tanning qualities. The salt may be used if there is insufficient salt residue in the hide to hold or retain the hair until the cream can take effect. Phenol may be eliminated, also, if the hide is exposed to air for extended time periods.

EXAMPLE III

In the same manner as in Examples I and II above, a composition of the following quantification was prepared:

| Ingredient | Weight or Volume | Parts By Weight |
|---|---|---|
| borax | 15 Lbs. | 6.7 |
| sodium chloride | 5.5 Lbs. | 2.5 |
| alum | 13 Lbs. | 1.9 |
| water | 28 Gals. | 100.0 |
| "YLA" | 8.6 Lbs. | 3.8 |
| "Dymasol" | 15 Gals. | 51 |
| "Mobil Met" | 15 Gals. | 50.2 |
| phenol | 1.5 Oz. | <1 |
| Methanol | 2 Gals. | 5.4 |
| "Aerosil" | 30 Lbs. | 13.4 |

The solution is once again prepared by heating the total quantity of the water to 135° F., adding the total quantities of borax, sodium chloride, phenol and one-third of the alum as well as the entire quantities of water-emulsive oil, stirring until well-blended. Stirring is discontinued and one-third of the Aerosil and the remainder of the alum are introduced into the mixture, which is then stirred until blended. Thereafter, the balance of the Aerosil is introduced, followed by a final stirring operation. The composition thus produced demonstrated excellent utility in carrying out the process of tanning hides.

In the application of the tanning cream to the skin, generally no preliminary preparation is required with the possible exception of oily skins, such as, bear skins which require a preliminary degreasing operation in accordance with well-known practice. As stated, the pH level of the cream or solution is most desirably held in the range of 4.5 to 5.5 since animal skins typically have a pH level on the order of 6.5 but can be most effectively preserved by reducing the pH level to some point on the order of 5.5. In certain cases, it is necessary to salt the skins as a preliminary to shaving and to wash out the skins after soaking in a salt solution. After the cream or tanning solution has been applied, the skin is laid out, flesh side up, and covered with burlap overnight before mounting for taxidermy purposes. In applications where the cream is to be used for fur tanning by drumming, the cream is applied and allowed to dry into the skin for several days after which a hardwood sawdust is drummed in for approximately twenty minutes. The sawdust is then removed and the skins permitted to dry overnight following which they are drummed again until dry.

If pickling is desired, the preferred practice is to pickle the skin, bring its pH level up to 5.5 in a soda ash solution, drain, then apply the tanning cream. The skin then can be mounted after the cream has penetrated or dried and/or drummed and relaxed.

It is to be understood that various modifications and changes may be made in the preferred and alternate forms of tanning composition as well as the methods of preparing same without departing from the spirit and scope of the present invention as defined by the appended claims.

We claim:

1. An animal hide tanning composition comprising in solution by weight minor proportions of borax, alum and an emulsifying agent, and a major proportion of a carrier, said carrier containing water and a water-emulsive oil.

2. The composition according to claim 1, said borax and alum being hydrated, and including minor proportions of sodium chloride.

3. The composition according to claim 1, said borax and alum being present on the order of 5.5 to 7.5 parts by weight and a sodium chloride being added on the order of 1 to 3 parts by weight.

4. The composition according to claim 1, said emulsifying agent being present on the order of 10 to 14 parts by weight, and there being added in a minor proportion with respect to said composition a blending compound comprising isopropylamine dodecylbenzene sulfonate.

5. The composition according to claim 4, said water-emulsive oil being selected from vegetable oils and metal cutting oils present alone or in combination on the order of 90 to 105 parts by weight together with equal parts by weight of water.

6. The method of preparing a tanning solution comprising the steps of introducing borax and alum in minor proportions by weight with respect to said tanning solution into a vessel containing water at an elevated temperature, adding a major proportion of water-emulsive oil and followed by adding and intermixing an emulsifying agent together with additional quantities of alum sufficient to maintain the pH level of the composition at less than 5.5.

7. The method according to claim 6, including the step of adding limited amounts of a parasiticide and bactericide.

8. The method according to claim 7 including the step of adding additional quantities of an emulsifying agent after introducing said additional quantities of alum.

9. An animal hide tanning composition comprising by weight (a) about 100 parts of water; (b) about 5.5 to 7 parts of borax; (c) about 10 parts of an emulsifying agent; (d) about 5.5 to 7.5 parts alum; and (3) about 90 to 105 parts water-emulsive oil.

10. The composition according to claim 9, there being about 10 to 14 parts of said emulsifying agent, and including a blending compound composed of an isopropyl amine dodecylbenzene sulphonate.

11. The composition according to claim 9 having in addition an effective quantity of a bactericide and of a parasiticide.

12. The process of preparing an animal hide-tanning composition, said method comprising: (a) constantly stirring into about 100 parts by weight of water at about 135° F. about 5.5 to 7 parts by weight of borax, about 1.8 to 2.5 parts by weight alum, about 1 to 3 parts by weight sodium chloride, and about 90 to 105 parts by weight water-emulsive oil; (b) adding to the resultant mixture of (a) about 3 to 5 parts by weight emulsifying agent and about 3.7 to 5 parts by weight alum, then stirring into said mixture of (a); and (c) adding to the resultant mixture of (b) about 7 to 9 parts by weight emulsifying agent, then stirring into said mixture of (b).

13. The process according to claim 12 in addition constantly stirring into the water during the first stirring period an effective quantity of a bacteriacide and a parasiticide.

14. The process according to claim 13, wherein the composition has in addition effective amounts of a bactericide and a parasiticide.

15. The process of tanning an animal hide, said method comprising applying to said hide a sufficient amount of a composition comprising by weight, 100 parts of water, about 5.5 to 7 parts of borax; about 5.5 to 7.5 parts alum, about 90 to 105 parts water-emulsive oil, and about 10 to 14 parts by weight of an emulsifying agent.

16. The process according to claim 15, wherein the composition has in addition about 10 to 14 parts emulsifying agent.

* * * * *